US012440878B2

(12) United States Patent
Fürst et al.

(10) Patent No.: US 12,440,878 B2
(45) Date of Patent: Oct. 14, 2025

(54) REDUCTION OF SURFACE DEFECTS DURING FINISH ROLLING OF HOT STRIP

(71) Applicant: Primetals Technologies Austria GmbH, Linz (AT)

(72) Inventors: Heinz Fürst, Gallneukirchen (AT); Franz Hermann Glaser, Haid bei Ansfelden (AT); Simon Grosseiber, Leonding (AT); Slaven Ilic, Linz (AT); Lukas Preuler, Randegg (AT); Juergen Schiefer, Allhaming (AT); Christian Strasser, Linz (AT)

(73) Assignee: Primetals Technologies Austria GmbH, Linz (AT)

( * ) Notice: Subject to any disclaimer, the term of this patent is extended or adjusted under 35 U.S.C. 154(b) by 151 days.

(21) Appl. No.: 18/081,517

(22) Filed: Dec. 14, 2022

(65) Prior Publication Data

US 2023/0226584 A1 Jul. 20, 2023

(30) Foreign Application Priority Data

Jan. 18, 2022 (EP) ..... 22151963

(51) Int. Cl.

| | |
|---|---|
| ***B21B 45/02*** | (2006.01) |
| ***B21B 1/22*** | (2006.01) |
| ***B21B 1/26*** | (2006.01) |
| ***B21B 13/22*** | (2006.01) |
| ***B21B 27/10*** | (2006.01) |

(Continued)

(52) U.S. Cl.

CPC ..... *B21B 13/22* (2013.01); *B21B 1/227* (2013.01); *B21B 1/26* (2013.01); *B21B 27/10* (2013.01); *B21B 28/02* (2013.01); *B21B 45/004* (2013.01); *B21B 2027/103* (2013.01)

(58) Field of Classification Search

CPC . B21B 45/02; B21B 45/0269; B21B 45/0287; B21B 45/029; B21B 27/10; B21B 39/14

See application file for complete search history.

(56) References Cited

U.S. PATENT DOCUMENTS

| | | | | |
|---|---|---|---|---|
| 4,272,976 | A | 6/1981 | Pizzedaz | |
| 11,338,339 | B2 | 5/2022 | Opitz et al. | |
| 2019/0210080 | A1 * | 7/2019 | Serizawa | B21B 45/0233 |

FOREIGN PATENT DOCUMENTS

| | | | | |
|---|---|---|---|---|
| DE | 102008019548 | A1 * | 10/2009 | B21B 39/14 |
| EP | 3308868 | A1 | 4/2018 | |
| JP | H04228217 | A | 8/1992 | |

OTHER PUBLICATIONS

European Search Report received in European Application No. 22151963.0 dated Jul. 4, 2022, 5 pages.

* cited by examiner

*Primary Examiner* — Debra M Sullivan

(74) *Attorney, Agent, or Firm* — Liang & Hennessey LLP; Brian Hennessey

(57) ABSTRACT

The invention relates to a finishing train for finish rolling hot strip. It is the object of the invention to modify an existing finishing train in such a way that the surface quality of the hot strip produced is improved without, however, significantly increasing the use of energy during production. This is intended to enable the thin hot strip produced to be used even for applications with high demands on surface quality. This object is achieved by a cleaning nozzle which cleans the upper side of the exit table, thus ensuring that scale and/or rolling dust are/is removed from the exit table.

20 Claims, 5 Drawing Sheets

(51) Int. Cl.
*B21B 28/02* (2006.01)
*B21B 45/00* (2006.01)

REDUCTION OF SURFACE DEFECTS DURING FINISH ROLLING OF HOT STRIP

CROSS-REFERENCE TO RELATED APPLICATIONS

The present application claims the priority benefit of European Patent Application No. 22151963.0, filed Jan. 18, 2022, entitled "REDUCTION OF SURFACE DEFECTS DURING FINISH ROLLING OF HOT STRIP", which is incorporated by reference in its entirety.

BACKGROUND OF THE INVENTION

1. Field of the Invention

The present invention relates to the technical field of hot rolling, preferably of steel.

2. Description of the Related Art

Nowadays, the majority of steel or aluminum feedstock in strip form is produced at low cost by hot rolling; the products are referred to as hot strip. Hot rolling typically takes place in what is known as a hot rolling mill or a combined casting/rolling plant, in which a continuous casting machine is coupled in-line with the hot rolling mill. In this case, the strand, which is typically produced continuously in the continuous casting machine, is either finish rolled directly thereafter in a finish rolling mill to give a finished strip, or the strand is first of all roughed in a roughing mill to form a roughed strip, and the roughed strip is then finish rolled immediately thereafter in the finish rolling mill to give the finished strip.

Until a few years ago, it was not possible to produce thin, very thin or ultra-thin strips by hot rolling. Continuous rolling on an Arvedi ESP combined casting/rolling plant, in particular, has since then made it possible to produce ultra-thin steel strips having a thickness of <0.8 mm or even ≤0.6 mm industrially by hot rolling. Further developments on the materials side have also made it possible to produce directly produced hot strip (i.e. without subsequently cold rolling the hot strip) with a high ductility. This makes it possible to use thin, ductile hot strip directly for deep-drawing, for example. Today, therefore, hot strip can be used directly for many products for which in the past only cold strip could be used.

When using hot strip, however, its surface quality can be problematic. Thus, according to the prior art, it is still necessary to produce parts which must have a high or very high surface quality, such as exterior bodywork parts, by cold rolling. As a result, the use of energy and the costs of production increase sharply. It is not evident from the prior art how the surface quality of hot strip can be improved without increasing the use of energy.

SUMMARY OF THE INVENTION

It is the object of the invention to modify a finishing train for producing very thin hot strip in such a way that the surface quality of the hot strip produced is improved without, however, significantly increasing the use of energy during production. This is intended to enable the thin hot strip produced to be used even for applications with high demands on surface quality.

This object is achieved, on the one hand, by a finishing train as claimed. Advantageous embodiments form the subject matter of the dependent claims.

Specifically, the object is achieved by a finishing train for finish rolling (thin or very thin) hot strip, preferably made of steel, wherein the finishing train has a plurality of roll stands, wherein the roll stands each have a lower and an upper working roll and the working rolls each form a roll gap, with the result that the hot strip passes through the roll gaps in the transport direction during finish rolling and is finish rolled in the process, wherein, during the finish rolling, at least one exit-side region of the lateral surface of the lower working roll of the last roll stand in the transport direction is cooled by a plurality of cooling nozzles arranged below a pass line, and the cooling nozzles spray a liquid cooling medium onto the lateral surface, wherein the cooling medium is kept away from the hot strip by at least one stripper arranged vertically between the cooling nozzles and the hot strip, wherein the stripper is secured on an exit table, and wherein at least one cleaning nozzle is provided for cleaning the upper side of the exit table with a liquid or gaseous medium, thus ensuring that scale and/or rolling dust are/is removed at least from the upper side of the exit table.

In the finish rolling of thin hot strip, the lateral surfaces of the working rolls are cooled by liquid cooling medium (e.g. cooling water) in order, on the one hand, to increase the service life of the working rolls and, on the other hand, in order to impede temperature-related deformation of the roll contour. However, in order to cool the rolling stock or hot strip as little as possible, the cooling medium is kept away from the rolling stock or hot strip by strippers.

Investigations by the applicant have shown that, in particular, very thin hot strip with a thickness of <1.2 mm sometimes has surface scratches on the underside and this can be attributed to contact with scale, rolling dust, etc., in the exit region of the last roll stand of the finishing train (see FIG. 7). Although, even in continuous operation, thin hot strip is clamped between the roll gap of the last roll stand and the driving rollers ahead of the "flying shears" after the cooling section, waves can occur in the middle region of the hot strip, with the result that the underside of the hot strip (in particular wave anti nodes on the underside of the hot strip) is (are) scratched by scale, rolling dust, etc. The cleaning of the upper side of the exit table by means of a liquid or gaseous medium during operation reliably prevents scale, rolling dust, dirt, etc. from accumulating there and these residues from baking on due to high temperatures and high moisture. This reliably prevents the build-up of scale, rolling dust, dirt, etc., in the exit region of the last roll stand, and therefore the finishing train according to the invention can ensure a high surface quality of the hot strip. In the following, cleaning by means of a liquid medium is also referred to as spray-cleaning, and cleaning by means of a gaseous medium as scavenging.

The exit table is cleaned either continuously during hot rolling or depending on the time in which hot strip is rolled. The exit table is preferably cleaned during hot rolling by short pulses at relatively high pressure. This achieves a better cleaning effect than continuous cleaning or spray-cleaning/scavenging at a low or medium pressure. The pulses can be generated, for example, by a valve which is arranged in the feed line of the medium.

Of course, it is possible for the cleaning nozzle or nozzles to be provided not only in the last roll stand of the finishing train but also in other or all of the roll stands. Moreover, it is possible to clean not only the exit table but also what is referred to as the feed table (i.e. the table on the entry side).

The cleaning nozzle or cleaning nozzles are arranged substantially horizontally (and thus in the width direction of the hot strip), and therefore residues are sprayed off or scavenged away from the exit table in the width direction of the hot strip.

The cleaning nozzles are typically supplied with a pressurized liquid cooling medium, preferably the same cooling medium which is used to cool the working rolls. As a result, a jet which spray-cleans the upper side of the exit table is formed on the front side of the spray nozzle. Alternatively, it is possible to operate the cleaning nozzles with a gaseous medium (e.g. air) under pressure.

The spraying effect is improved if at least one first cleaning nozzle is arranged on the drive side of the roll stand and at least one second cleaning nozzle is arranged on the operator side of the roll stand. As a result, the exit table is cleaned or spray-cleaned from two sides, so that even relatively large/heavy particles can be removed.

It is advantageous if the cleaning nozzles are designed as flat jet nozzles and, in particular, if the cleaning nozzle on the drive side has an offset in the transport direction relative to the cleaning nozzle on the operator side. In the second case, the confluence of spray jets in the middle of the hot strip is prevented, thus ensuring that particles are always removed from the strip.

Moreover, it is advantageous if the width b of the outlet opening of the cleaning nozzle is greater, preferably at least 3 times greater, than the height h of the outlet opening. In other words, $b>h$ or preferably $b \geq 3 \cdot h$.

Finally, it is advantageous if the cleaning nozzle is not arranged exactly horizontally but is inclined by an angle $\alpha$ relative to the horizontal, ensuring that the upper side of the exit table is cleaned or spray-cleaned without, however, acting on the underside of the hot strip.

It is furthermore very advantageous if, in the transport direction, at least one lifting roller, which is arranged in the width direction of the hot strip, is arranged between the last roll stand and a cooling section for cooling the finish-rolled hot strip, and the lifting roller lifts the hot strip in the vertical direction above the pass line during the finish rolling, with the result that the underside of the hot strip does not touch the exit table.

Simple tubing or piping of the cleaning nozzle(s) is achieved if a pipe or hose line fluidically connects a cooling nozzle to at least one cleaning nozzle.

The technical object is likewise achieved by a finishing train as claimed. Advantageous embodiments form the subject matter of the dependent claims.

Specifically, the object is achieved by a finishing train for finish rolling (thin or very thin) hot strip, preferably made of steel, wherein the finishing train has a plurality of roll stands, wherein the roll stands each have a lower and an upper working roll and the working rolls each form a roll gap, with the result that the hot strip passes through the roll gaps in the transport direction and is finish rolled in the process, wherein, during the finish rolling, at least one exit-side region of the lateral surface of the lower working roll of the last roll stand in the transport direction is cooled by a plurality of cooling nozzles arranged below a pass line, and the cooling nozzles spray a liquid cooling medium onto the lateral surface, wherein the cooling medium is kept away from the hot strip by at least one stripper arranged vertically between the finish-rolled hot strip and the cooling nozzles, wherein the stripper is secured on an exit table, wherein, in the transport direction, at least one lifting roller, which is arranged in the width direction of the hot strip, is arranged between the last roll stand and a cooling section for cooling the finish-rolled hot strip, and the lifting roller can lift the hot strip in the vertical direction above the pass line during the finish rolling, with the result that the underside of the hot strip does not touch the exit table.

In this alternative solution for achieving the technical object according to the claims, contact between the underside of the hot strip and the upper side of the exit table is also reliably prevented. The lifting roller is an "ordinary" roller and not a roller that can be used for flatness inspection of the hot strip. Rollers for flatness inspection are expensive and sensitive and are not intended to be included within the scope of protection. The flatness inspection is preferably carried out optically.

A first, preferably optical, surface inspection unit for inspecting the upper side of the hot strip is preferably arranged between the lifting roller and a first cooling unit of the cooling section.

According to a further advantageous embodiment, a pyrometer and a first blow-cleaning device for blow-cleaning the upper side of the hot strip are arranged between the last roll stand and the first surface inspection unit. The pyrometer is preferably situated upstream of the blow-cleaning device in the transport direction.

According to a further advantageous embodiment, a second, preferably optical, surface inspection unit for inspecting the underside of the hot strip is arranged between a last cooling unit of the cooling section and shears.

It is advantageous if a pyrometer and a second blow-cleaning device for blow-cleaning the upper side of the hot strip are arranged between the second surface inspection unit and the shears. The blow-cleaning device is preferably situated upstream of the pyrometer in the transport direction.

In a typical embodiment, a driving-roller unit having at least one drivable driving roller which can be placed against the hot strip is arranged between the second blow cleaning device and the shears.

The finishing train preferably comprises a controller, which is is connected to a drive for lifting the lifting roller and the second surface inspection unit for inspecting the underside of the hot strip, wherein the controller lifts the lifting roller further as soon as the second surface inspection unit detects surface defects on the underside of the hot strip. In this case, the information about surface defects on the underside of the hot strip is automatically used to further lift the lifting roller and thus to increase the distance between the hot strip and the pass line.

As an alternative to this, the lifting roller can also be extended further manually.

A combined casting/rolling plant preferably comprises a continuous casting plant for the continuous casting of a strand, optionally a roughing train for the roughing of the strand to form an intermediate strip, and the finishing train according to the invention. In this case, an induction heater for heating the intermediate strip to rolling temperature is preferably arranged between the typically multi-stand roughing train and the finishing train.

In a further embodiment, a tunnel furnace for thoroughly heating and/or maintaining the temperature of the strand is arranged upstream of the roughing train.

It is advantageous that the roughing train has three roll stands and the finishing train has five roll stands. This configuration has proven itself in Arvedi ESP plants and is also of great advantage for other combined casting/rolling plants.

BRIEF DESCRIPTION OF THE DRAWINGS

The above-described properties, features and advantages of this invention and the manner in which these are achieved will become more clearly and distinctly comprehensible in conjunction with the following description of an exemplary embodiment, which is explained in greater detail in conjunction with the drawings. In the drawings.

DETAILED DESCRIPTION

Figure 1:
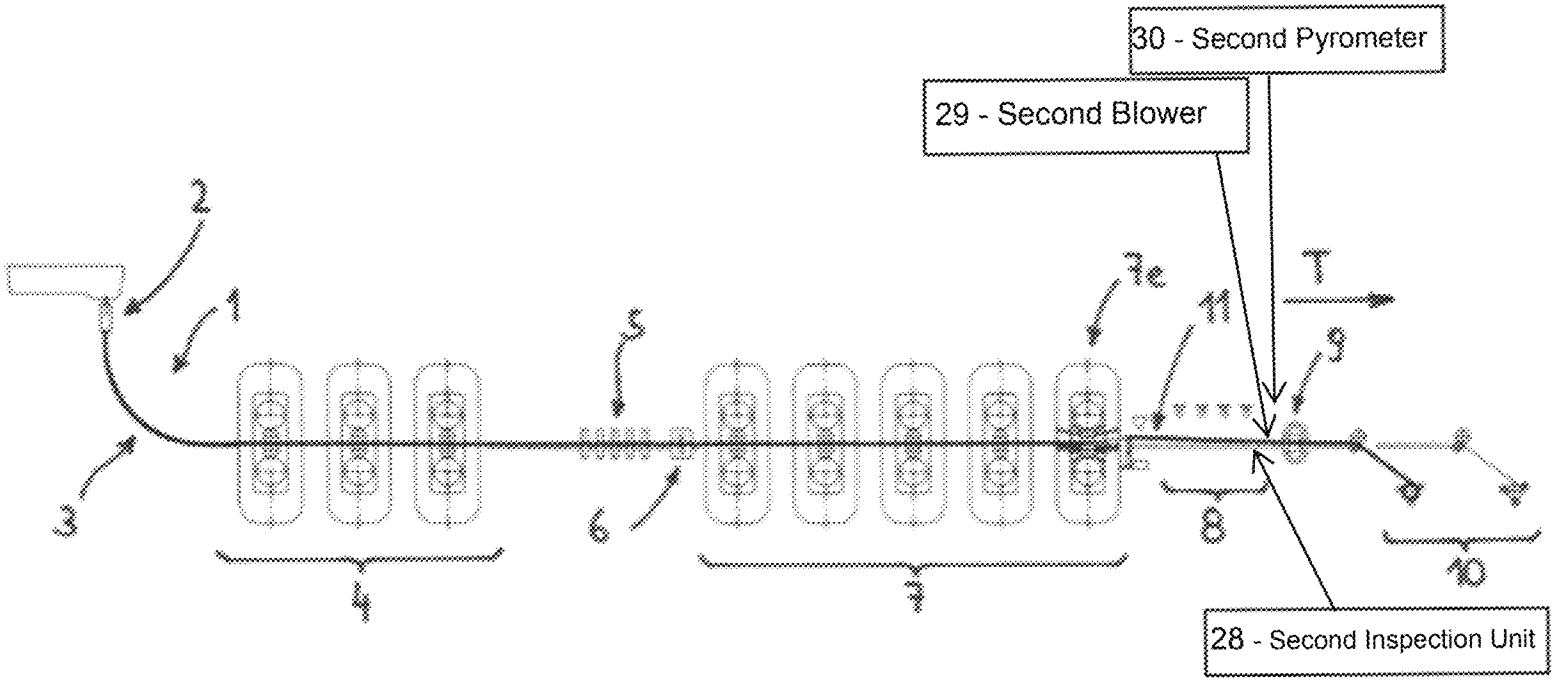
FIG. 1 shows a schematic illustration of a combined casting/rolling plant embodied according to the invention.

FIG. 1 shows a diagram of a combined casting/rolling plant for producing thin hot-rolled steel strip. Liquid steel is cast in the mold 2 of the continuous casting machine 1 to form a strand with a slab or thin slab cross section and is continuously drawn out of the mold 2. The strand is supported, guided and further cooled in the arcuate strand guide 3 and is then bent back into the horizontal. The solidified strand is then roughed in the roughing train 4 to form a roughed strip. After this, the roughed strip is heated to rolling temperature by the furnace 5, preferably an induction furnace having a plurality of induction modules, and descaled by a descaler 6 before entering the finishing train 7. In the finishing train 7, the roughed strip is finish-rolled to form the hot strip (also called finished strip). The finished strip typically has a thickness of between 0.6 and 3.6 mm. After finish rolling, the hot strip 11 is cooled to coiling temperature in the cooling section 8 by a plurality of cooling units. Shortly before coiling, the cooled hot strip 11 is divided transversely into coil lengths by shears 9 and coiled by a plurality of coiling or winding devices 10 or, alternatively, by a rotatable carousel coiler. Particularly in the production of thin or very thin hot strip, it is advantageous to operate the combined casting/rolling plant continuously.

According to the invention, after the last roll stand 7*e* of the finishing train 7 there is a lifting roller 18 for lifting the finished strip above the pass line P and/or at least one cleaning nozzle 17 for cleaning the upper side of the exit table 15 with a liquid medium (e.g. cooling water) or scavenging with a gaseous medium (for example air), thus ensuring that scale and/or rolling dust are/is removed from the exit table 15.

In the former case, the finish-rolled hot strip 11 is lifted above the pass line P by the lifting roller 18, which is arranged in the width direction of the hot strip 11, thus ensuring that contact between the underside of the hot strip 11 and the exit table 15 is avoided in all cases.

In the second case, at least the exit table 15, and, according to a variant for very thin strips also the feed table 24, of the at least last roll stand 7*e* of the finishing train 7 are freed from scale and/or rolling dust by at least one cleaning nozzle 17, thus ensuring that no impurities can accumulate on the upper side of the exit table 15 which could scratch the underside of the hot strip 11.

Figure 2:
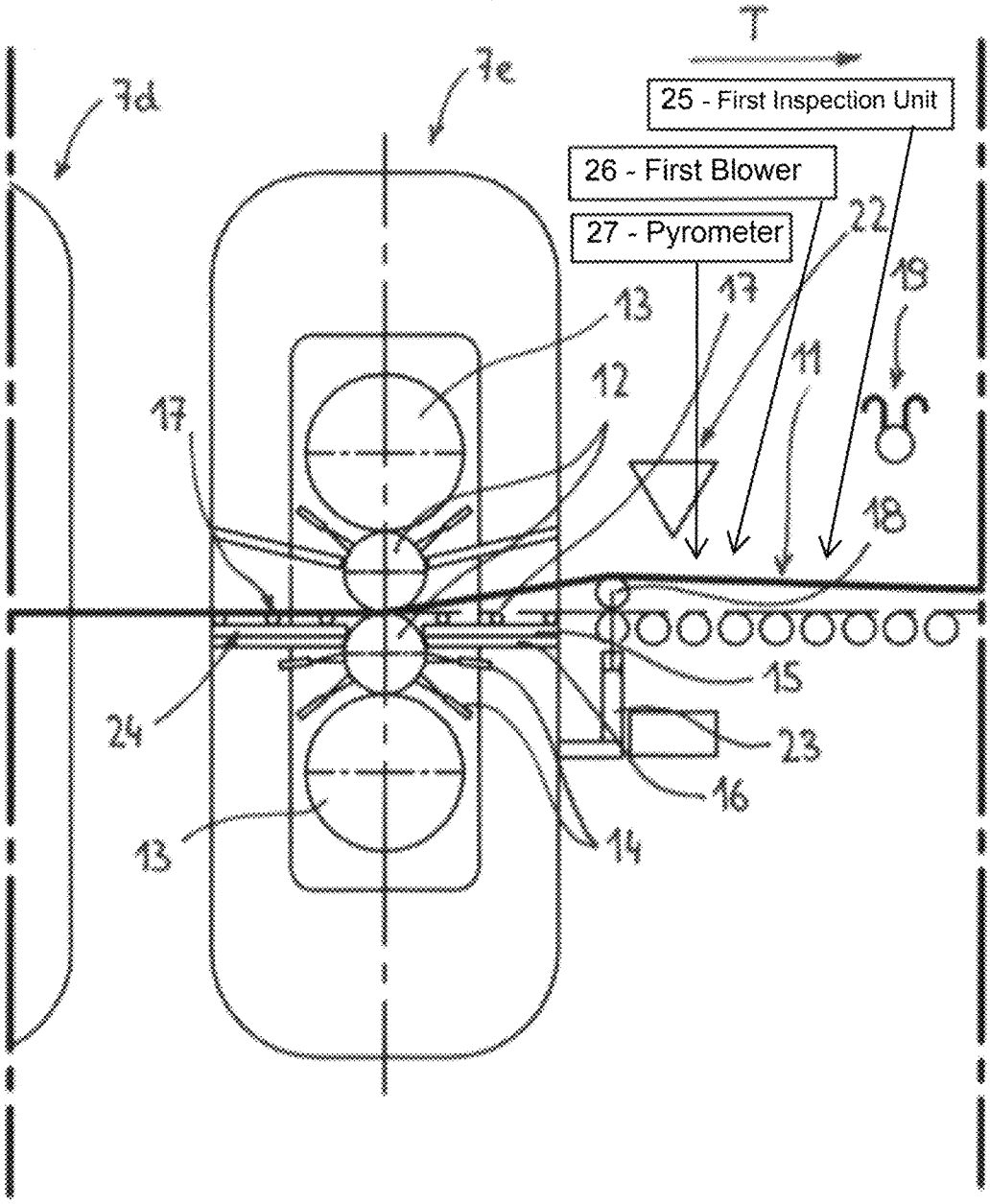
FIG. 2 shows a detail illustration of the last roll stand of the finishing train with a lifting roller and a plurality of cleaning nozzles for spray-cleaning the upper side of the exit table.

According to a preferred embodiment, both said cases are combined, i.e. a lifting roller 18 and at least one cleaning nozzle 17 are present after the last roll stand 7*e*. This case is illustrated in FIG. 2.

Figure 3:
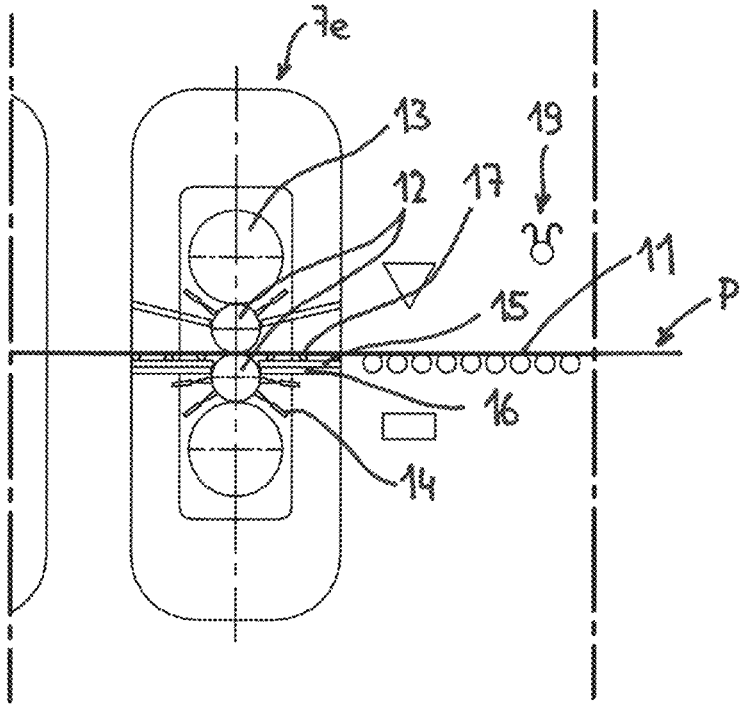
FIG. 3 shows a detail illustration of the last roll stand of the finishing train with a plurality of cleaning nozzles for spray-cleaning the upper side of the exit table.
Figure 4:
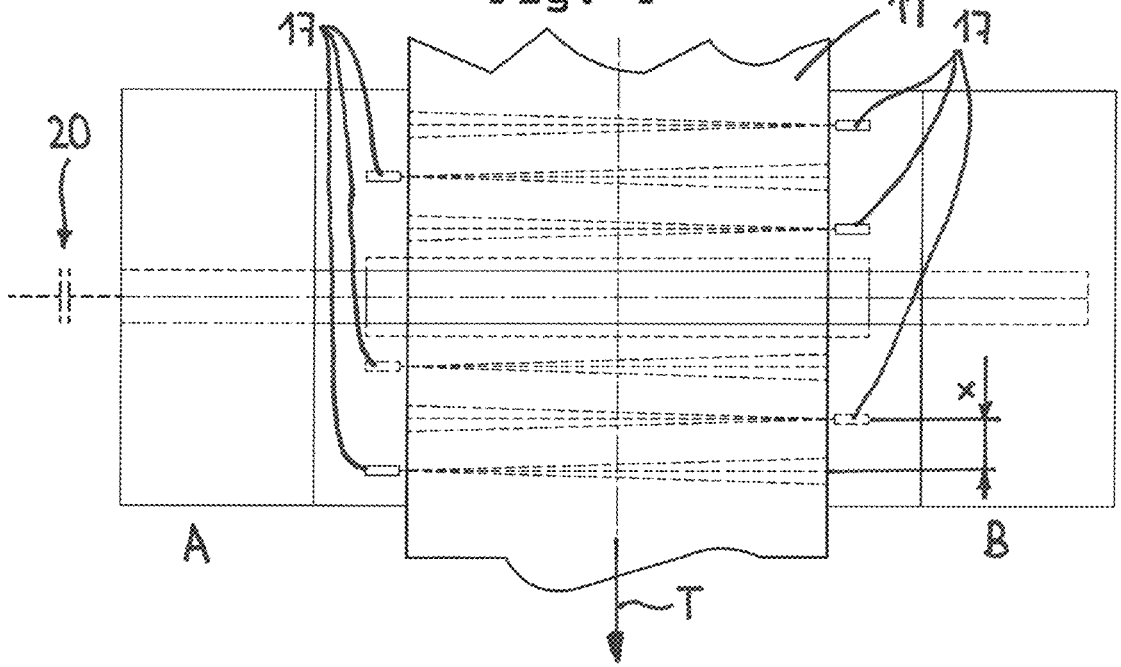
FIG. 4 shows a plan view of the roll stand and the exit table of the last roll stand of the finishing train with the cleaning nozzles from FIG. 3.

FIGS. 3 and 4 show the case in which three cleaning nozzles 17, one on the drive side A and two on the operator side B of the roll stand 7*e*, are arranged on the exit table 15. The cleaning nozzles 17 each have an offset x in the transport direction T. In addition to the cleaning nozzles 17 on the exit table 15, a further three cleaning nozzles 17 are arranged on the feed table 24. These cleaning nozzles 17 too serve to clean the upper side of the feed table by spray-cleaning or scavenging scale, rolling dust, etc.

Figure 5A:
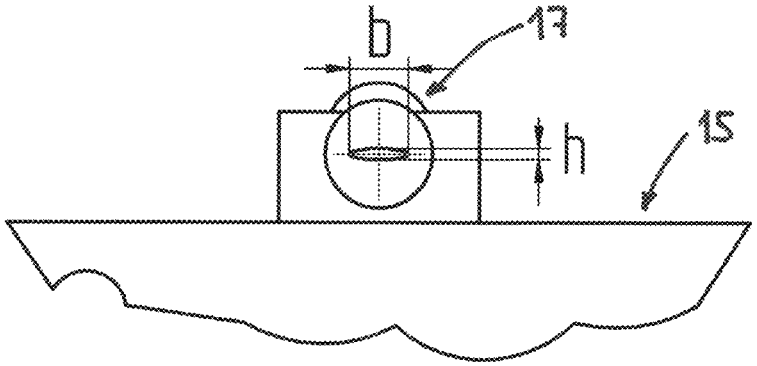
FIG. 5*a* shows a front view with a cleaning nozzle for spray-cleaning the upper side of the exit table.
Figure 5B:
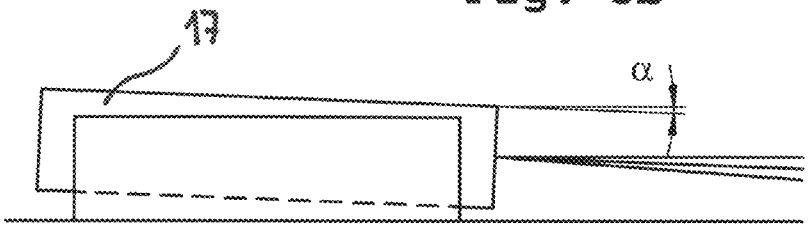
FIG. 5*b* shows a side view of the cleaning nozzles from FIG. 5*a*.

FIGS. 5*a* and 5*b* show a front and a side view of a cleaning nozzle 17 which is arranged on the upper side of the exit table 15. The cleaning nozzle 17 is a flat jet nozzle, wherein the spray jet is wider than it is high. Specifically, the outlet opening of the cleaning nozzle 17 has a width b which is at least 3 times as wide as the height h of the outlet opening. As a result, a flat full jet is formed. In addition, the cleaning nozzle 17 is inclined relative to the horizontal by the angle $\alpha$, ensuring that the upper side of the exit table 15 is spray-cleaned without cooling the underside of the hot strip (not illustrated).

Figure 6:
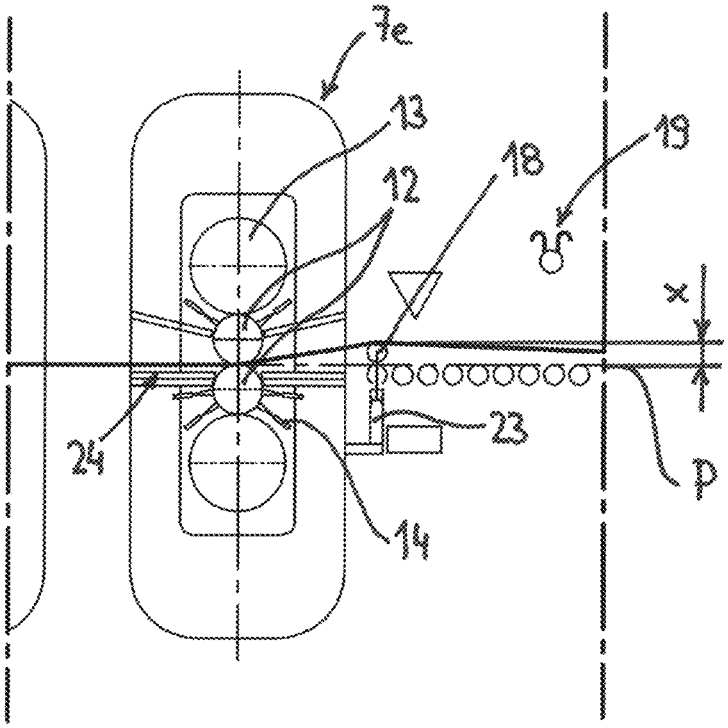
FIG. 6 shows a detail illustration of the last roll stand of the finishing train with a lifting roller for lifting the hot strip so that the underside of the hot strip does not touch the exit table.

FIG. 6 shows the last roll stand 7*e* of the finishing train 7 with a lifting roller 18 for lifting the finish-rolled hot strip 11 above the pass line P. Specifically, the rotatable, horizontally arranged lifting roller 18 is lifted by a linear drive 23, thus ensuring that the hot strip 11 comes to lie above the pass line P of the roll stand 7*e*. This ensures that there is no contact between the underside of the hot strip 11 and the exit table 15. The hot strip 11 can be lifted in a position-controlled and/or force-controlled manner. By means of the position control, an actual distance x in the vertical direction between the upper side of the exit table 15 and the underside of the hot strip 11 is set. Force control prevents the hot strip 11, which is typically thin or very thin, from being overstretched. The two controls are preferably superimposed on one another, thus ensuring that both the position of the lifting roller 18 and the elongation of the hot strip 11 are set in a controlled manner.

Figure 7:
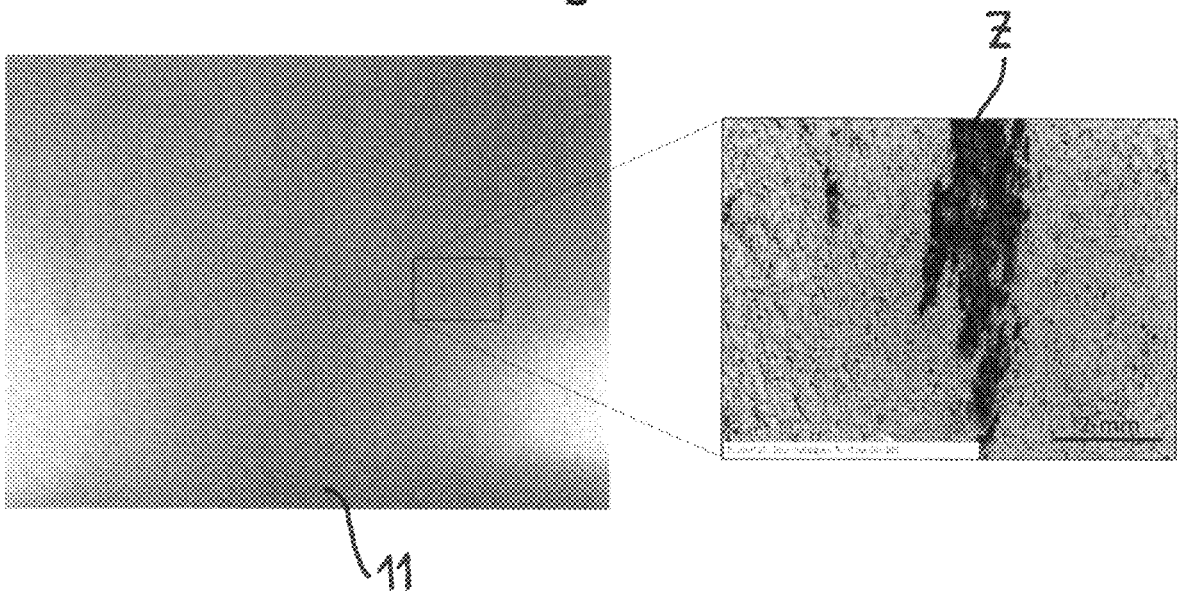
FIG. 7 shows a photograph of a surface defect on the underside of a hot strip which has been scratched by scale after finish rolling.

The photograph in FIG. 7 shows a surface defect on the underside of a thin hot strip 11 which has been scratched by scale Z after finish rolling. These surface defects are avoided by the invention, thereby increasing the quality and yield of the hot strip.

Although the invention has been illustrated and described more specifically in detail by means of the preferred illustrative embodiments, the invention is not restricted by the examples disclosed, and other variations can be derived therefrom by a person skilled in the art without exceeding the scope of protection of the invention.

LIST OF REFERENCE SIGNS

1 continuous casting machine
2 mold
3 strand guide
4 roughing train
furnace

6 descaler
7 finishing train
7*a* . . . 7*e* roll stand
8 cooling section
9 shears
coiling or winding device
11 hot strip
12 working roll
13 back-up roll
14 cooling nozzle
exit table
16 stripper
17 cleaning nozzle
18 lifting roller
19 cooling unit of the cooling section
20 drive train
22 thickness measurement
23 lifting device
24 feed table
25 first inspection unit
26 first blower
pyrometer
second inspection unit
29 second blower
30 second pyrometer
A drive side
α inclination angle of the cleaning nozzle to the horizontal
B operator side
b width of the outlet opening
h height of the outlet opening
P pass line
T transport direction
X offset
Z scale

The invention claimed is:

1. A finishing train for finish rolling hot strip, comprising:

a plurality of roll stands, the roll stands each having a lower and an upper working roll and the working rolls each form a roll gap, the hot strip configured to pass through the roll gaps in a transport direction during finish rolling;

a plurality of cooling nozzles arranged below a pass line, the cooling nozzles configured to spray a liquid cooling medium onto a lateral surface during the finish rolling to cool at least one exit-side region of the lateral surface of the lower working roll of the last roll stand in the transport direction;

at least one stripper arranged vertically between the cooling nozzles and the hot strip, the at least one stripper configured to keep the cooling medium away from the hot strip, the at least one stripper being secured on an exit table; and at least one cleaning nozzle configured to clean an upper side of the exit table to remove at least one of scale and rolling dust.

2. The finishing train as claimed in claim 1, wherein the finishing train is configured to process steel.

3. The finishing train as claimed in claim 1, wherein:

at least one of the at least one cleaning nozzles is arranged on a drive side of the roll stand; and at least one other of the at least one cleaning nozzles is arranged on an operator side of the roll stand.

4. The finishing train as claimed in claim 3, wherein the at least one of the at least one cleaning nozzles on the drive side has an offset in the transport direction relative to the at least one other of the at least one cleaning nozzles on the operator side.

5. The finishing train as claimed in claim 1, wherein one of a pipe and a hose line fluidically connects a cooling nozzle to at least one of the at least one cleaning nozzles.

6. A finishing train for finish rolling hot strip, comprising:

a plurality of roll stands, the roll stands each having a lower and an upper working roll and the working rolls each form a roll gap, the hot strip configured to pass through the roll gaps in a transport direction during finish rolling;

a plurality of cooling nozzles arranged below a pass line, the cooling nozzles configured to spray a liquid cooling medium onto a lateral surface during the finish rolling to cool at least one exit-side region of the lateral surface of the lower working roll of the last roll stand in the transport direction;

at least one stripper arranged vertically between the cooling nozzles and the hot strip, the at least one stripper configured to keep the cooling medium away from the hot strip, the at least one stripper being secured on an exit table;

at least one lifting roller in the transport direction which is arranged in a width direction of the hot strip, is arranged between the working rolls of the last roll stand and a cooling section for cooling the finish-rolled hot strip, the lifting roller configured to lift the hot strip in a vertical direction above the pass line during the finish rolling, so that an underside of the hot strip does not touch the exit table; and at least one cleaning nozzle configured to clean an upper side of the exit table to remove at least one of scale and rolling dust.

7. The finishing train as claimed in claim 6, wherein the finishing train is configured to process steel.

8. The finishing train as claimed in claim 6, further comprising a first inspection unit arranged between the lifting roller and a first cooling unit of the cooling section.

9. The finishing train as claimed in claim 8, wherein the first surface inspection unit comprises an optical surface inspection unit.

10. The finishing train as claimed in claim 8, further comprising a second surface inspection unit arranged between a last cooling unit of the cooling section and shears.

11. The finishing train as claimed in claim 10, wherein the second surface inspection unit comprises an optical surface inspection unit.

12. The finishing train as claimed in claim 10, further comprising a second pyrometer and a second blow-cleaning device arranged between the second surface inspection unit and shears.

13. The finishing train as claimed in claim 12, further comprising a driving-roller unit having at least one drivable driving roller which can be placed against the hot strip is arranged between the second blow-cleaning device and the shears.

14. The finishing train as claimed in claim 13, further comprising:

a controller connected to a drive for lifting the lifting roller and the second surface inspection unit for inspecting the underside of the hot strip;

wherein the controller lifts the lifting roller further as soon as the second surface inspection unit detects surface defects on the underside of the hot strip.

15. The finishing train as claimed in claim 6, further comprising a pyrometer and a first blow-cleaning device arranged between the last roll stand and the first surface inspection unit.

16. A combined casting/rolling plant, comprising:

a continuous casting plant for the continuous casting of a strand; and the finishing train as claimed in claim 1.

17. The combined casting/rolling plant as claimed in claim 16, further comprising:

a roughing train for roughing the strand to form an intermediate strip; and a furnace configured to heat the intermediate strip to a rolling temperature.

18. The combined casting/rolling plant as claimed in claim 17, wherein the furnace is an induction furnace.

19. The combined casting/rolling plant as claimed in claim 17, wherein the roughing train comprises three roll stands and the finishing train comprises five roll stands.

20. The combined casting/rolling plant as claimed in claim 16, further comprising a tunnel furnace arranged upstream of the roughing train, the tunnel furnace configured to at least one of thoroughly heat and maintain a temperature of the strand.

* * * * *